US011558932B2

(12) United States Patent
Huang

(10) Patent No.: US 11,558,932 B2
(45) Date of Patent: Jan. 17, 2023

(54) ELECTRIC BLANKET

(71) Applicant: GUANGDONG LAIJUN ELECTRONIC TECHNOLOGY CO., LTD., Guangdong (CN)

(72) Inventor: Wanglai Huang, Dongguan (CN)

(73) Assignee: GUANGDONG LAIJUN ELECTRONIC TECHNOLOGY CO., LTD., Guangdong (CN)

( * ) Notice: Subject to any disclaimer, the term of this patent is extended or adjusted under 35 U.S.C. 154(b) by 409 days.

(21) Appl. No.: 16/840,450

(22) Filed: Apr. 5, 2020

(65) Prior Publication Data

US 2021/0315058 A1 Oct. 7, 2021

(51) Int. Cl.

*H05B 1/02* (2006.01)
*H05B 3/34* (2006.01)
*H05B 3/00* (2006.01)

(52) U.S. Cl.

CPC ..... *H05B 1/0272* (2013.01); *H05B 3/342* (2013.01); *H05B 2203/014* (2013.01); *H05B 2203/035* (2013.01)

(58) Field of Classification Search

CPC ..... H05B 3/342; H05B 3/34; H05B 1/0272
See application file for complete search history.

(56) References Cited

U.S. PATENT DOCUMENTS 5,420,397 A * 5/1995 Weiss ..... G05D 23/2401 219/508
5,770,836 A * 6/1998 Weiss ..... H05B 3/34 361/87
7,291,813 B1 * 11/2007 Huang ..... G05D 23/1917 219/505
2003/0052120 A1 * 3/2003 Zabrowsky ..... G05D 23/1905 219/501
2013/0134149 A1 * 5/2013 Weiss ..... H05B 3/56 219/481
2014/0034628 A1 * 2/2014 Chen ..... H05B 1/0272 219/212

* cited by examiner

*Primary Examiner* — Jermele M Hollington
*Assistant Examiner* — Temilade S Rhodes-Vivour
(74) *Attorney, Agent, or Firm* — Leong C. Lei

(57) ABSTRACT

An electric blanket includes an electric blanket body and a remote controller. The electric blanket body includes a first wireless module, a heating wire, a first power input circuit, and a first main control circuit. The remote controller includes a second main control circuit, a first function button circuit connected to the second main control circuit, a display circuit, a second wireless module, and a second power input circuit for supplying power.

9 Claims, 11 Drawing Sheets

42

ELECTRIC BLANKET

BACKGROUND OF THE INVENTION

1. Field of the Invention

The present invention relates to an electric blanket, and more particularly to an electric blanket that can be used conveniently.

2. Description of the Prior Art

With the development of science and technology, people's living standards are improved, especially the environmental requirements for living and working, such as the requirements for heating supplies and electric blankets. An electric blanket is often used indoors. It can be used on the ground, on a chair, or on a bed.

A conventional electric blanket is controlled by a remote controller or mobile terminal A conventional mobile terminal can only send control signals to the electric blanket unidirectionally. However, when the electric blanket is controlled by the remote controller, the operation of the remote controller cannot be fed back to the mobile terminal to achieve synchronous operation, which is inconvenient for use. Furthermore, the display of the operation is not synchronous, which may easily lead to wrong operations of the electric blanket and shorten the service life of the electric blanket.

Accordingly, the inventor of the present invention has devoted himself based on his many years of practical experiences to solve these problems.

SUMMARY OF THE INVENTION

In view of the shortcomings of the prior art, the primary object of the present invention is to provide an electric blanket that can be used conveniently. The user may operate one of a remote controller and a mobile terminal, and the other can simultaneously display the operating information. The user can observe the status of the electric blanket at any time, so that the user feels comfortable and the convenience of use is improved. It also ensures the accuracy, real-time and safety of the operation, reduces the possibility of wrong operations, and prolongs the service life of the electric blanket.

In order to achieve the above object, the present invention adopts the following technical solutions.

An electric blanket comprises an electric blanket body and a remote controller for remotely controlling the electric blanket body. The electric blanket body includes a first wireless module, a heating wire, a detection circuit, a first power input circuit for supplying power, and a first main control circuit for wirelessly connecting a mobile terminal. The first main control circuit is connected to the heating wire. The remote controller includes a second main control circuit, a first function button circuit connected to the second main control circuit, a display circuit, a second wireless module, and a second power input circuit for supplying power. The electric blanket body is in communication with the remote controller through the first wireless module and the second wireless module.

When the mobile terminal sends a control signal toward the electric blanket body, the first main control circuit of the electric blanket body controls the heating wire to work, and the first main control circuit sends a status of the electric blanket body to the remote controller so that the remote controller displays the status of the electric blanket body synchronously.

When the remote controller sends a control signal toward the electric blanket body, the first main control circuit of the electric blanket body controls the heating wire to work, and the first main control circuit sends a status of the electric blanket body to the mobile terminal so that the mobile terminal displays the status of the electric blanket body synchronously.

Compared with the prior art, the present invention has obvious advantages and beneficial effects. Specifically, the first main control circuit of the electric blanket body is wirelessly communicated with the mobile terminal in cooperation with the first wireless module and the second wireless module for wireless communication between the electric blanket body and the remote controller. The user may operate one of the remote controller and the mobile terminal, and the other can simultaneously display the operating information. The user can observe the status of the electric blanket at any time, so that the user feels comfortable and the convenience of use is improved. It also ensures the accuracy, real-time and safety of the operation, reduces the possibility of wrong operations, and prolongs the service life of the electric blanket.

DETAILED DESCRIPTION OF THE PREFERRED EMBODIMENTS

Embodiments of the present invention will now be described, by way of example only, with reference to the accompanying drawings.

As shown in FIG. 1 through FIG. 11, the present invention discloses an electric blanket that can be used conveniently. The electric blanket comprises an electric blanket body 10 and a remote controller 20 for controlling the electric blanket body 10 remotely.

Figure 1:
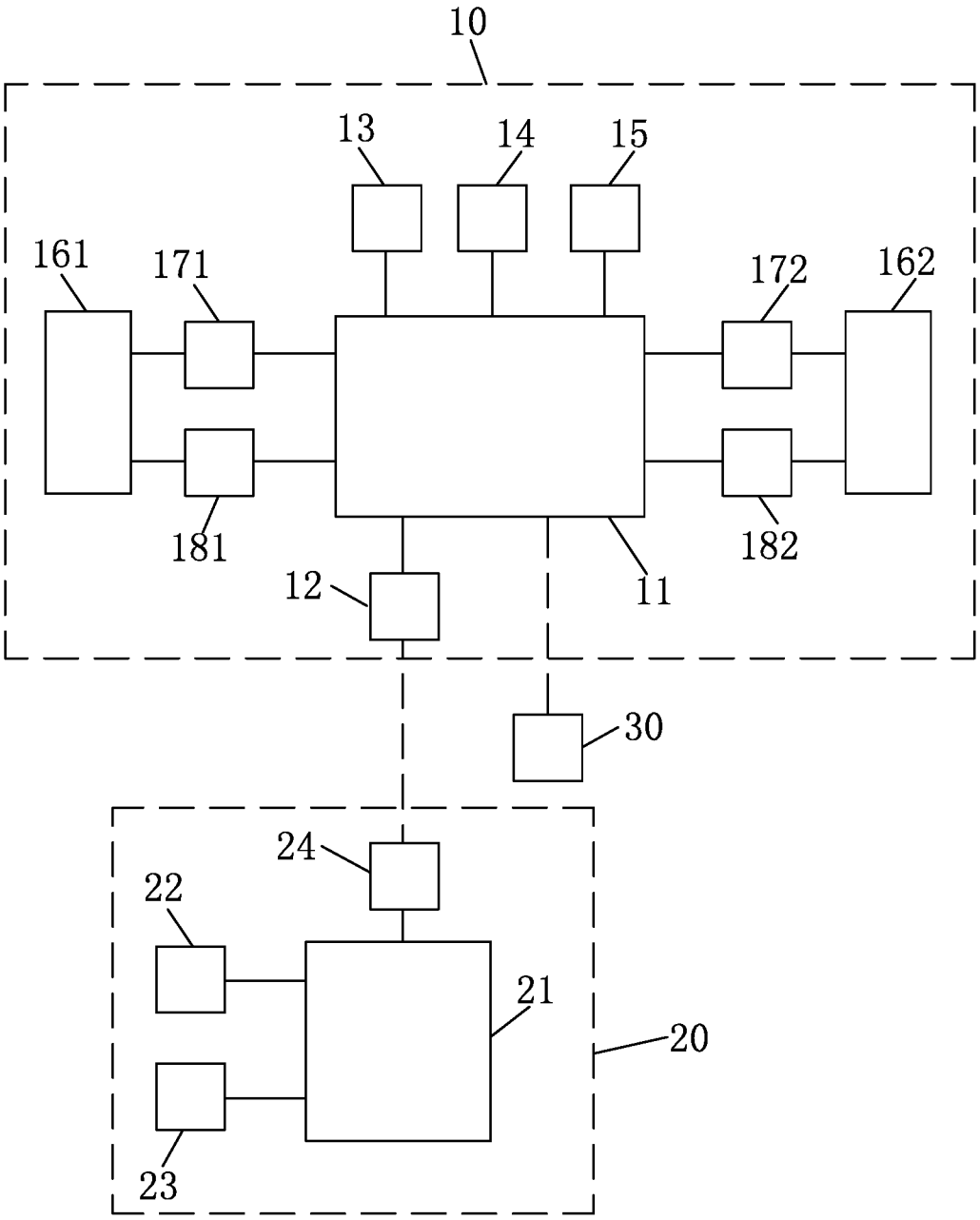
FIG. 1 is a block diagram according to an embodiment of the present invention.
Figure 2:
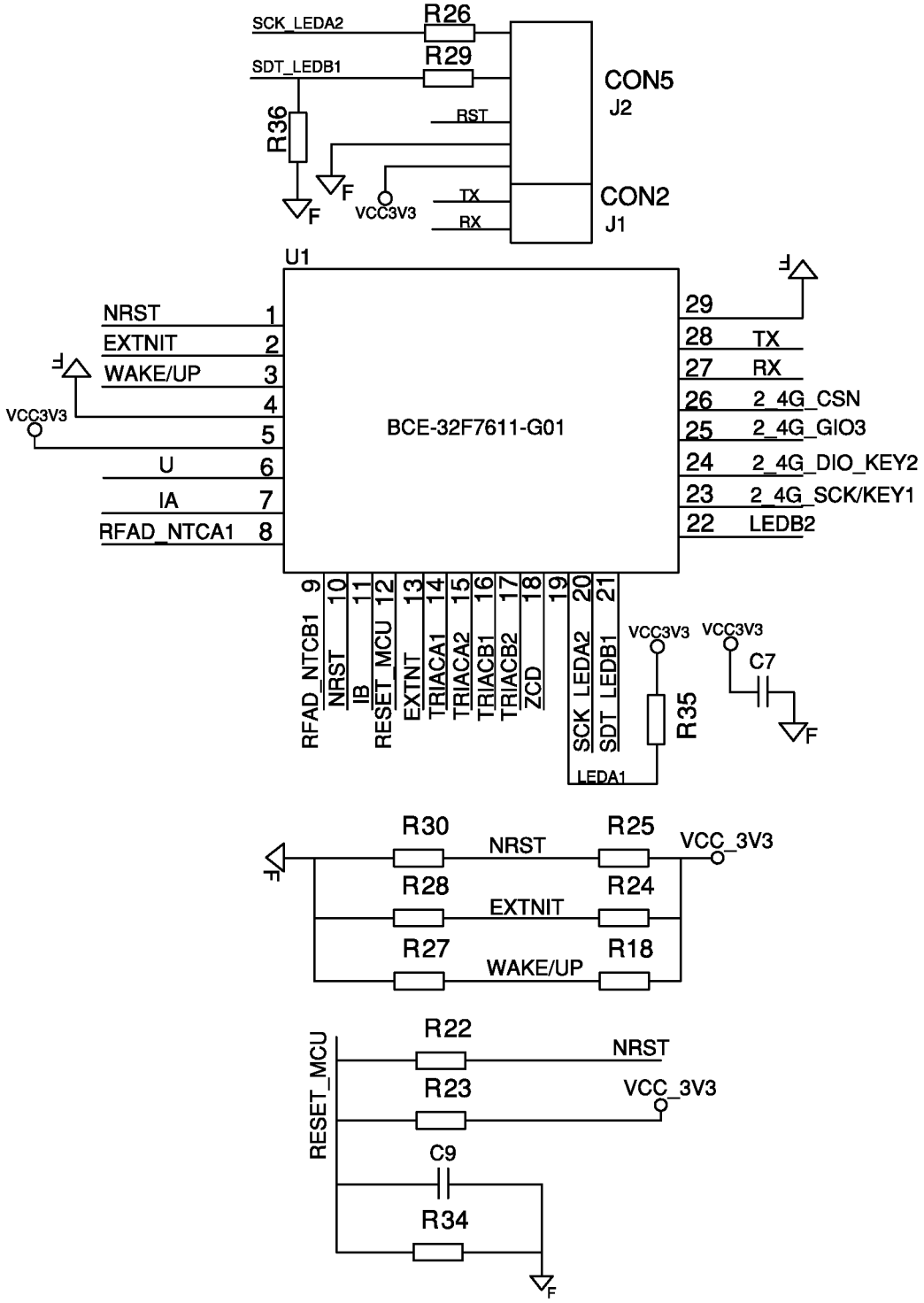
FIG. 2 is a circuit diagram of a first main control circuit according to an embodiment of the present invention.

The electric blanket body 10 includes a first wireless module 12, a heating wire, a detection circuit 13, a first power input circuit 41 for supplying power, and a first main control circuit 11 for wirelessly connecting a mobile terminal 30. The first main control circuit 11 is connected to the heating wire. In this embodiment, as shown in FIG. 2, the first main control circuit 11 is composed of a Bluetooth main control chip U1 with a model number BCE32F7611 and a peripheral circuit. The Bluetooth main control chip U1 has Bluetooth main control pins 1-29.

The heating wire includes at least two sub-heating wires. Each sub-heating wire is equipped with an overheat protection circuit for overheat detection and blowout. Each sub-heating wire is equipped with a constant temperature circuit. The first main control circuit 11 is connected to the overheat protection circuit. The electric blanket body 10 further includes a fuse F1 disposed between the live wire of the mains electricity and the first power input circuit 41. Each overheat protection circuit is connected to the fuse F1 for controlling the fuse F1 to blow. The first main control circuit 11 is connected to the corresponding sub-heating wire through the corresponding constant temperature circuit for controlling the working state of each sub-heating wire.

The overheat protection circuit includes a first diode, a second diode, a first unidirectional thyristor, a first resistor, a second resistor, a third resistor, a fourth resistor, and a temperature detection unit.

The first diode has a first anode and a first cathode for connecting the first power input circuit 41. The second diode has a second anode and a second cathode. The first anode and the second anode are connected to the temperature detection unit through the first resistor. The temperature detection unit is connected to the first main control circuit 11 through the third resistor. The first main control circuit 11 is further connected to an analog ground through the fourth resistor. Preferably, the temperature detection unit is a thermistor. The first resistor is a heating resistor. The heating resistor is disposed on one side of the fuse F1 so that the heat generated by the heating resistor can blow the fuse F1, or the heating resistor is closely connected to the fuse F1, but not limited thereto. If the temperature of the electric blanket body 10 exceeds the set maximum temperature or there is uncontrollable continuous heating, the Bluetooth main control pin 15 controls the first unidirectional thyristor to be turned on. At the same time, the Bluetooth main control pin 8 outputs a high current. The high current flows back to the null wire through the first resistor and the first diode in order. Because the first resistor is a heating resistor, the current increases to enable the first resistor to generate high heat to blow the fuse F1, so as to achieve an active blowout function and ensure the safety of the user.

The second cathode is connected to the analog ground. The T1 terminal of the first unidirectional thyristor is connected to the analog ground. The control terminal of the first unidirectional thyristor is connected to the first main control circuit 11 through the second resistor. The T2 terminal of the first unidirectional thyristor is connected to the temperature detection unit. The temperature detection unit is configured to detect whether the electric blanket is partially folded for use. If local overheating is detected, the electric blanket is determined to be partially folded for use. At this time, the first main control circuit 11 controls the constant temperature circuit 20 to temporarily stop heating the heating wire through the Bluetooth main control pin 8. When the local overheating reaches the safety limit of the fuse F1, passive blowout will be activated, that is, the temperature of the local overheating will reach the temperature at which the fuse F1 blows.

The constant temperature circuit includes a second unidirectional thyristor, a fifth resistor, a sixth resistor, and a capacitor. The control terminal of the second unidirectional thyristor is connected to the first main control circuit 11 through the sixth resistor and the capacitor. The T1 terminal of the second unidirectional thyristor is grounded. The T1 terminal of the second unidirectional thyristor is further connected to the control terminal of the second unidirectional thyristor through the fifth resistor and the sixth resistor. The T2 terminal of the second unidirectional thyristor is connected to the heating wire.

In order to improve the functionality of the electric blanket, in this embodiment, the heating wire is in the form of two sections. The heating wire of the electric blanket body 10 is divided into left and right sections or front and rear sections. It is convenient for the operator to control the corresponding section of the heating wire to be heated according to needs, thereby improving convenience and practicality.

Figure 5:
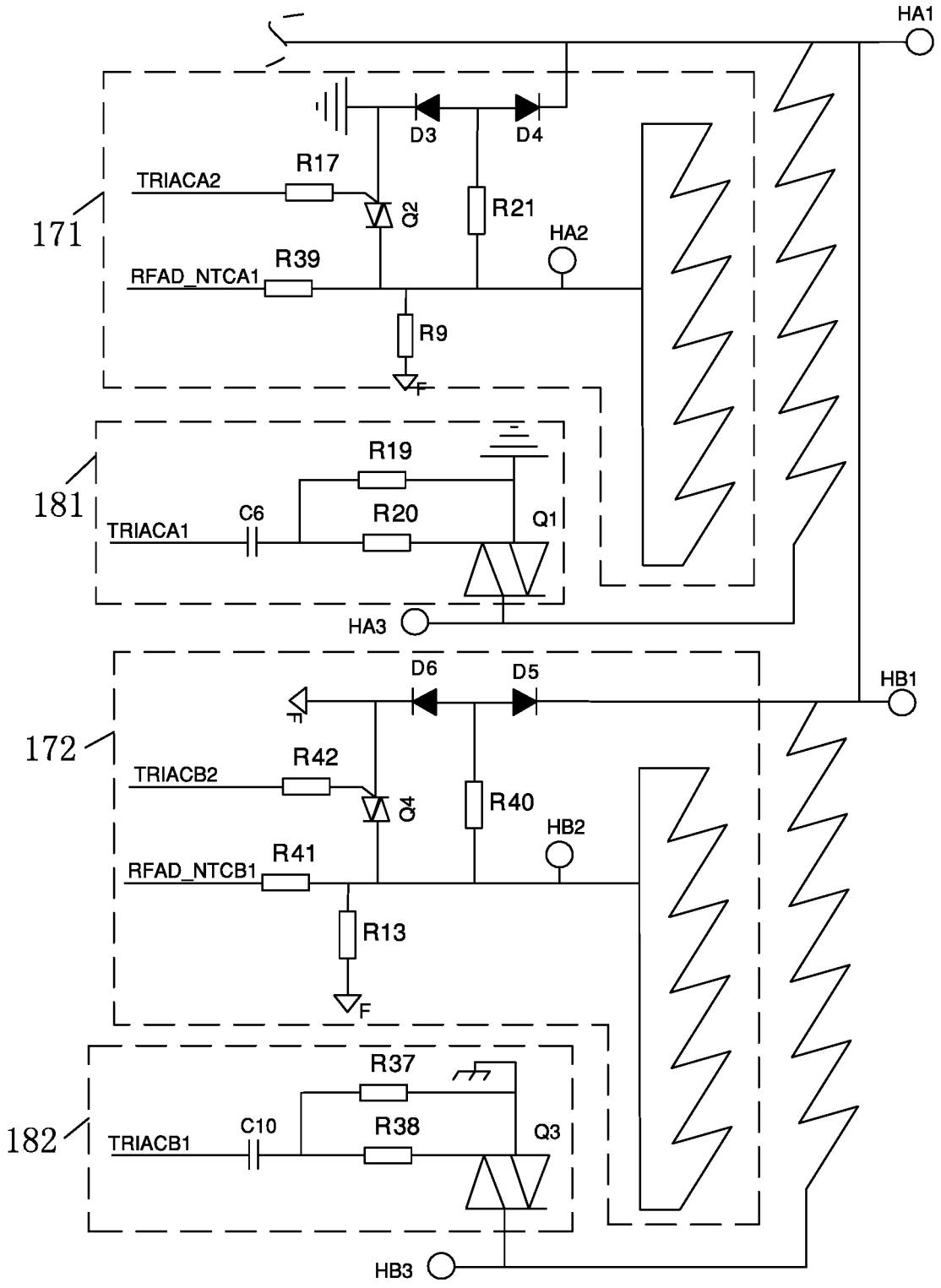
FIG. 5 is a circuit diagram for controlling and detecting a heating wire according to an embodiment of the present invention (mainly showing a first overheat protection circuit, a second overheat protection circuit, a first constant temperature circuit and a second constant temperature circuit)

Specifically, as shown in FIG. 5, the two sub-heating wires are defined as a first sub-heating wire 161 and a second sub-heating wire 162. The overheat protection circuit and the constant temperature circuit corresponding to the first sub-heating wire 161 are defined as a first overheat protection circuit 171 and a first constant temperature circuit 181, respectively. The overheat protection circuit and the constant temperature circuit corresponding to the second sub-heating wire 162 are defined as a second overheat protection circuit 172 and a second constant temperature circuit 182, respectively. The first sub-heating wire 161 has a first interface HA1 and a first interface HA3. The first interface HA1 of the first sub-heating wire 161 is connected to the neutral line and the first power input circuit 41. The second sub-heating wire 162 has a second interface HB1 and a second interface HB3. The first interface HA1 of the first sub-heating wire 161 is further connected to the second interface HB1 of the second sub-heating wire 162.

The first overheat protection circuit 171 includes a diode D4, a diode D3, a first unidirectional thyristor Q2, a resistor R21, a resistor R17, a resistor R39, a resistor R9, and a first thermistor 191.

The diode D4 has a first anode and a first cathode for connecting the null wire of the mains electricity. The diode D3 has a second anode and a second cathode. The first anode and the second anode are connected to the HA2 pin of the first thermistor 191 through the resistor R21. The HA2 pin of the first thermistor 191 is connected to the Bluetooth main control pin 8 through the resistor R39. The Bluetooth main control pin 8 is further connected to the analog ground through the resistor R9.

The second cathode is connected to the analog ground. The T1 terminal of the first unidirectional thyristor Q2 is connected to the analog ground. The control terminal of the first unidirectional thyristor Q2 is connected to the Bluetooth main control pin 15 through the resistor R17. The T2 terminal of the first unidirectional thyristor Q2 is connected to the HA2 pin of the first thermistor 191.

The first constant temperature circuit 181 includes a second unidirectional thyristor Q1, a resistor R19, a resistor R20, and a capacitor C6. The control terminal of the second unidirectional thyristor Q1 is connected to the Bluetooth main control pin 14 through the resistor R20 and the capacitor C6. The T1 terminal of the second unidirectional thyristor Q1 is connected to the digital ground. The T1 terminal of the second unidirectional thyristor Q1 is further connected to the control terminal of the second unidirectional thyristor Q1 through the resistor R19 and the resistor R20. The T2 terminal of the second unidirectional thyristor Q1 is connected to the first interface HA3 of the first sub-heating wire 161.

The second overheat protection circuit 172 includes a diode D6, a diode D5, a first unidirectional thyristor Q4, a resistor R40, a resistor R41, a resistor R42, a resistor R13, and a second thermistor 192.

The diode D5 has a first anode and a first cathode for connecting the null line of the mains electricity. The first cathode is further connected to the second interface HB1 of the second sub-heating wire 162. The diode D6 has a second anode and a second cathode. The first anode and the second anode are both connected to the HB2 pin of the second thermistor 192 through the resistor R40. The HB2 pin of the second thermistor 192 is connected to the Bluetooth main control pin 9 through the resistor R41. The Bluetooth main control pin 9 is further connected to the analog ground through the resistor R13.

The second cathode is connected to the analog ground. The T1 terminal of the first unidirectional thyristor Q4 is connected to the analog ground. The control terminal of the first unidirectional thyristor Q4 is connected to the Bluetooth main control pin 17 through the resistor R42. The T2 terminal of the first unidirectional thyristor Q4 is connected to the HB2 pin of the second thermistor 192.

The second constant temperature circuit 182 includes a second unidirectional thyristor Q3, a resistor R37, a resistor R38, and a capacitor C10. The control terminal of the second unidirectional thyristor Q3 is connected to the Bluetooth main control pin 16 through the resistor R38 and the capacitor C10. The T1 terminal of the second unidirectional thyristor Q3 is connected to the signal ground. The T1 terminal of the second unidirectional thyristor Q3 is further connected to the control terminal of the second unidirectional thyristor Q3 through the resistor R37 and the resistor R38. The T2 terminal of the second unidirectional thyristor Q3 is connected to the second interface HB3 of the second sub-heating wire 162.

The detection circuit 13 includes a resistor R2, a resistor R4, a resistor R10, a resistor R11, a resistor R12, a resistor R16, a fuse F2, and a fuse F3.

The resistor R11 has a first detection terminal and a second detection terminal for connecting the first power input circuit 41. The first detection terminal is connected to the analog ground through the resistor R12. The first main control circuit 11 is connected to the first detection terminal.

One end of the resistor R2 is connected to the digital ground. The other end of the resistor R2 is connected to the analog ground through the fuse F2. The first main control circuit 11 is connected to the digital ground through the resistor R10.

One end of the resistor R4 is connected to the signal ground. The other end of the resistor R4 is connected to the analog ground through the fuse F3. The first main control circuit 11 is connected to the signal ground through the resistor R16.

It should be noted that the detection circuit 13 in this embodiment can monitor whether there is an uncontrollable electrical signal in real time when the Bluetooth main control chip U1 is powered on but the user doesn't use the electric blanket (that is, the off state). If there is no uncontrollable electrical signal, the Bluetooth main control pin 18 will output a high current to the first resistor. Because the first resistor is a heating resistor, the current increases to enable the first resistor to generate high heat to blow the fuse F1, so as to achieve an active blowout function and ensure the safety of the user.

The electric blanket body 10 further includes a second function button circuit 14 and an indicator circuit 15 for displaying a working state and a fault state. The second function button circuit 14 and the indicator circuit 15 are both connected to the first main control circuit 11.

Figure 6:
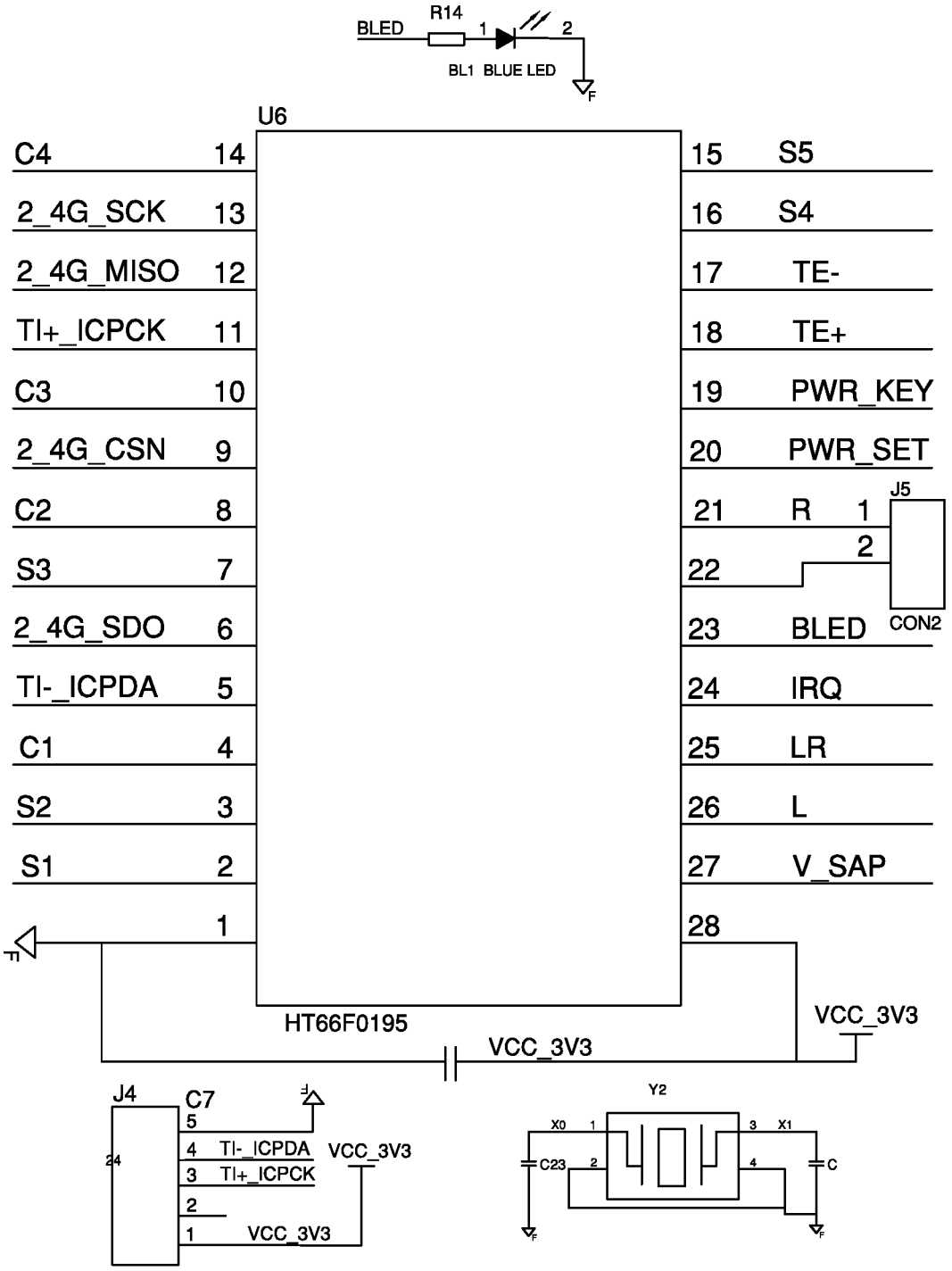
FIG. 6 is a circuit diagram of a second main control circuit according to an embodiment of the present invention.

The remote controller 20 includes a second main control circuit 21, a first function button circuit 22 connected to the second main control circuit 21, a display circuit 23, a second wireless module 24, and a second power input circuit 42 for supplying power. The first function button circuit 22, the display circuit 23, the second wireless module 24 and the second power input circuit 42 are connected to the second main control circuit 21. In this embodiment, as shown in FIG. 6, the second main control circuit 21 is composed of a main control chip U6 with a model number HF66F0195 and a peripheral circuit.

Figure 3:
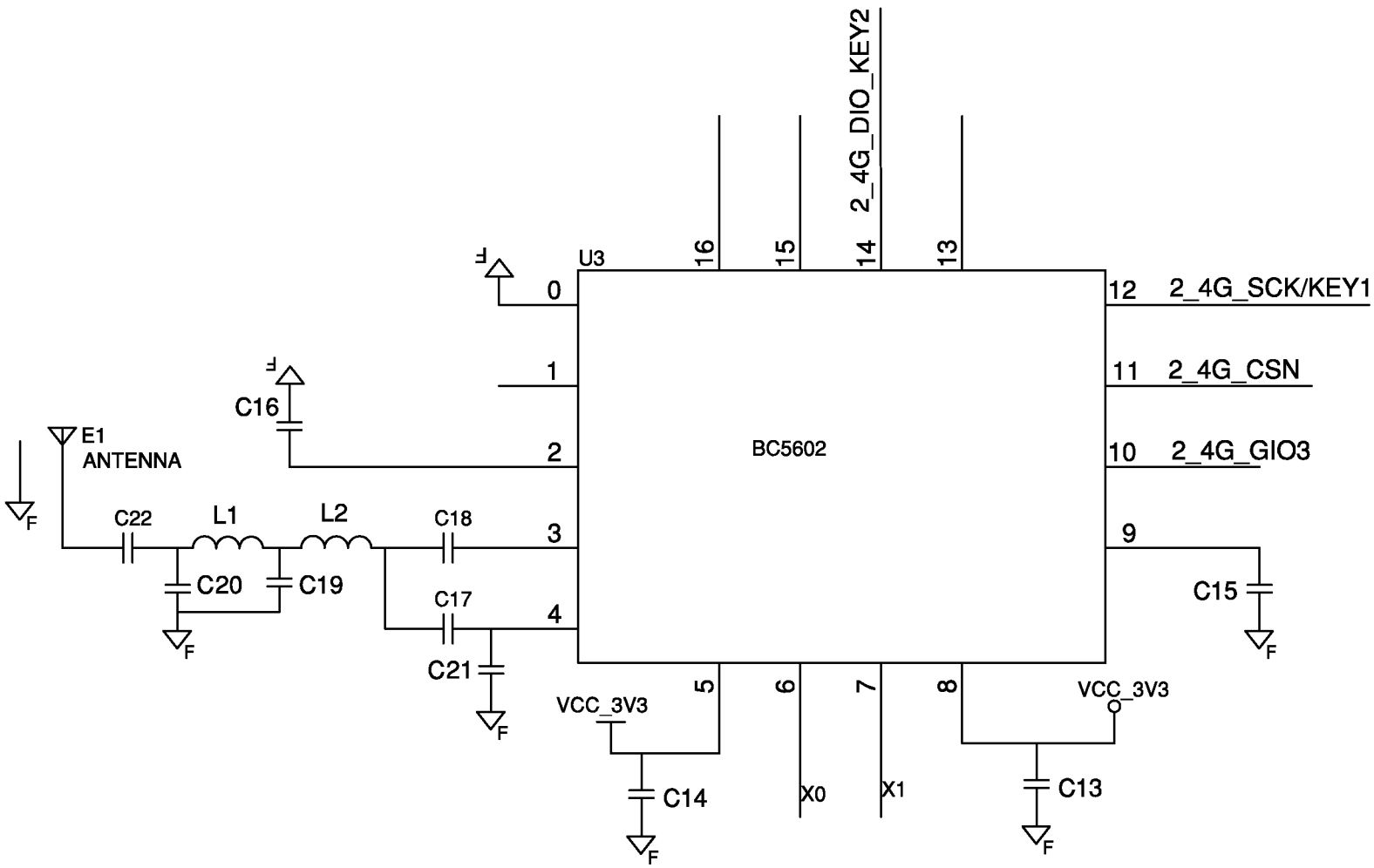
FIG. 3 is a circuit diagram of a first wireless module according to an embodiment of the present invention.
Figure 4:
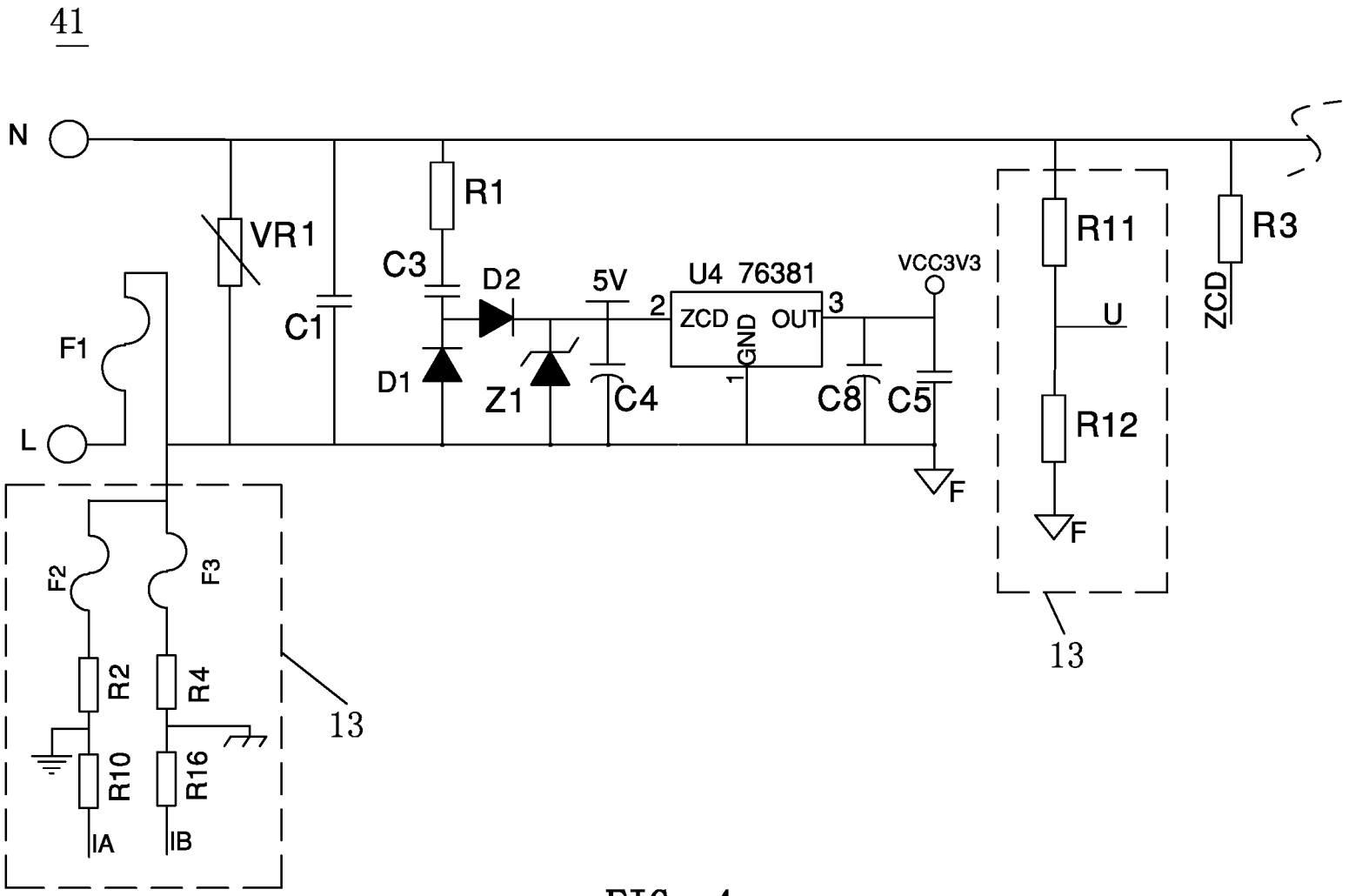
FIG. 4 is a circuit diagram of a first power input circuit according to an embodiment of the present invention.
Figure 7:
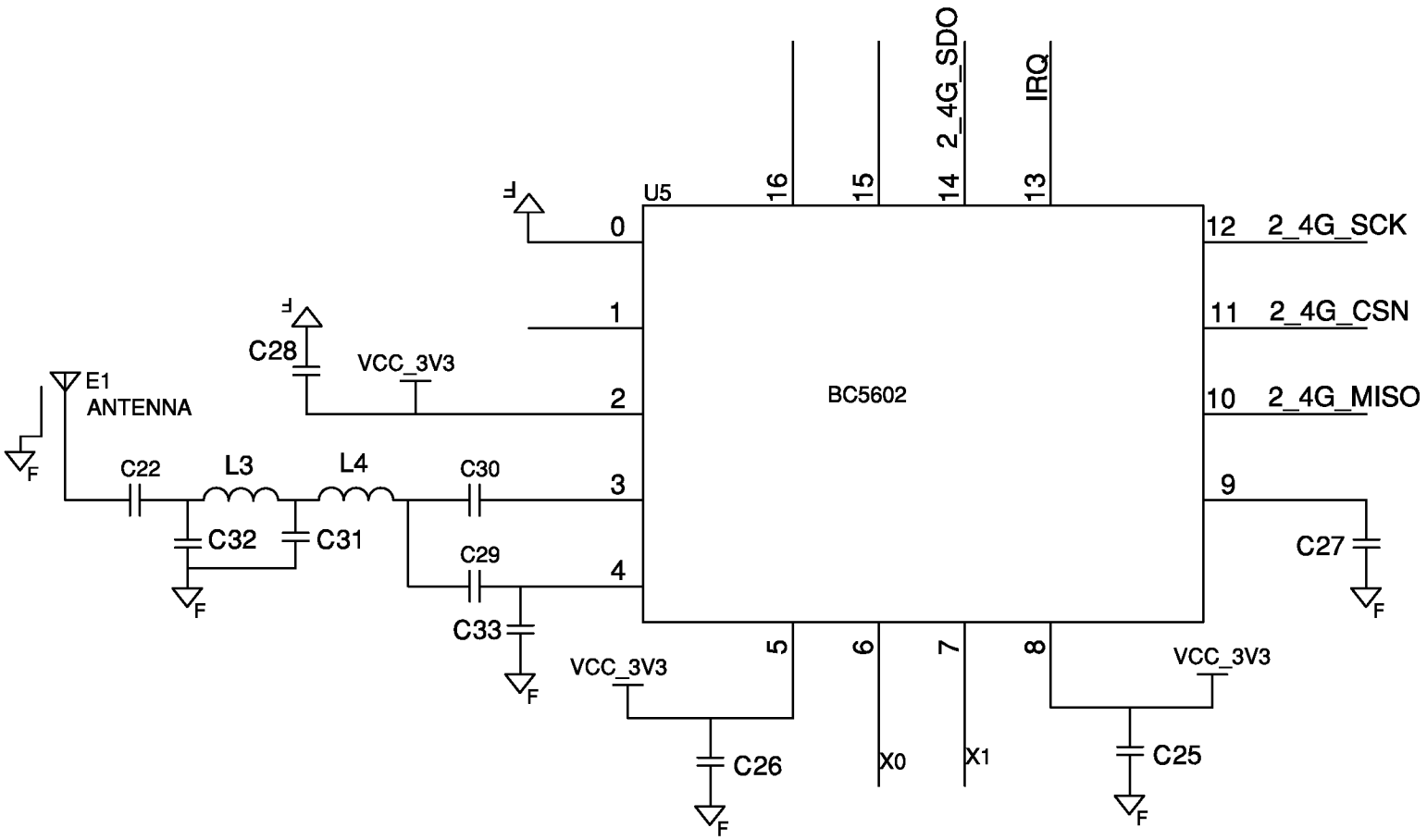
FIG. 7 is a circuit diagram of a second wireless module according to an embodiment of the present invention.
Figure 8:
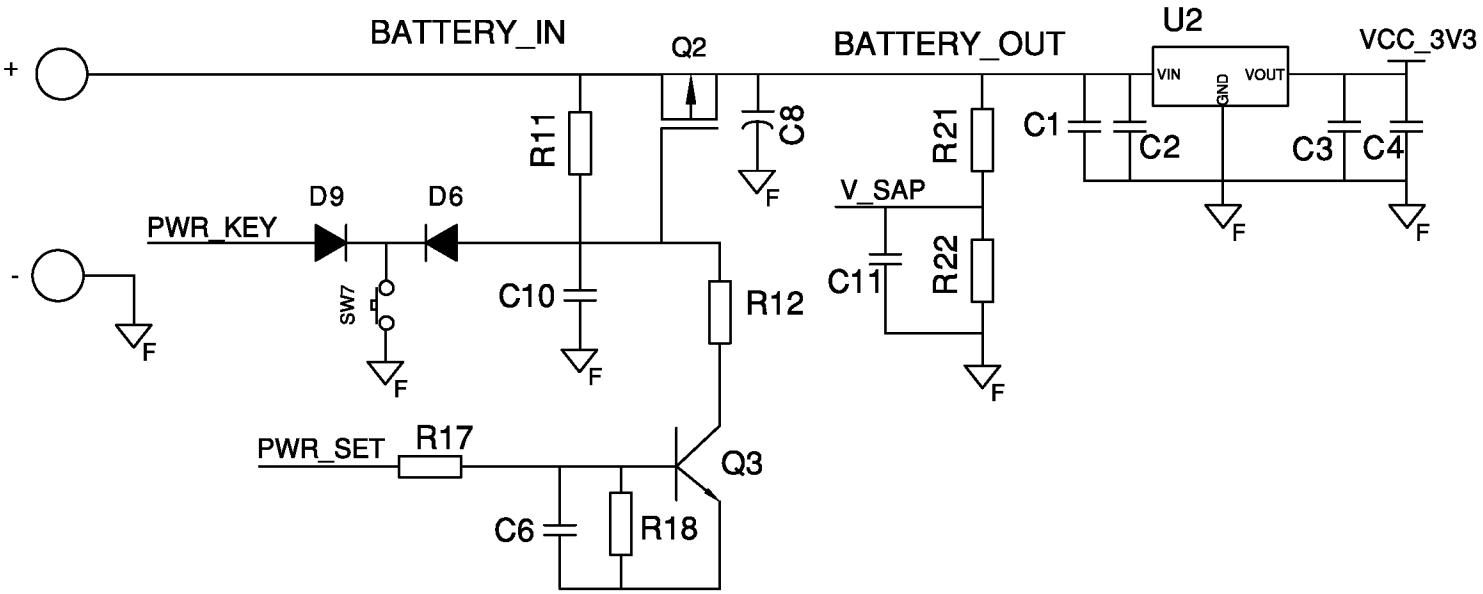
FIG. 8 is a circuit diagram of a second power input circuit according to an embodiment of the present invention.
Figure 9:
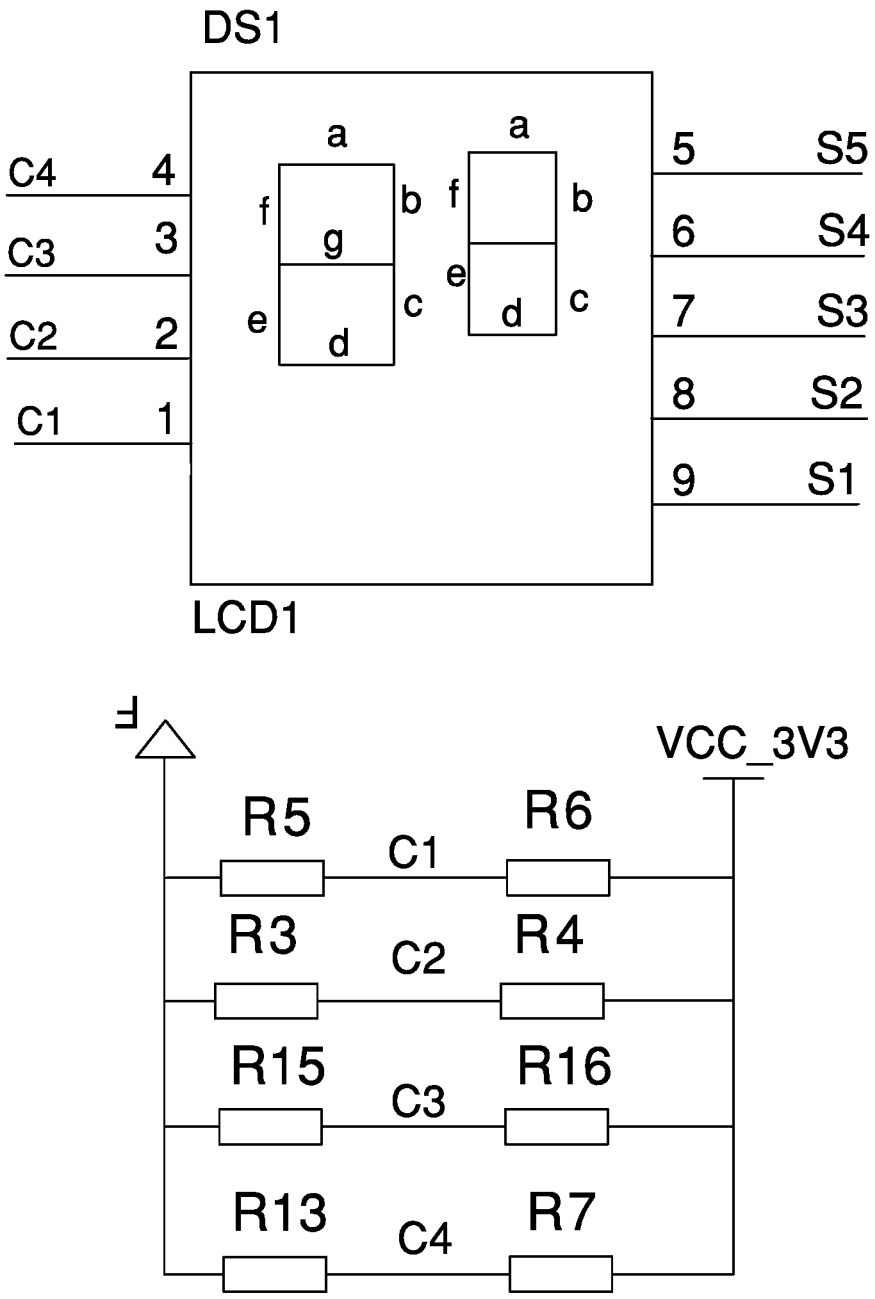
FIG. 9 is a circuit diagram of a display circuit according to an embodiment of the present invention.
Figure 10:
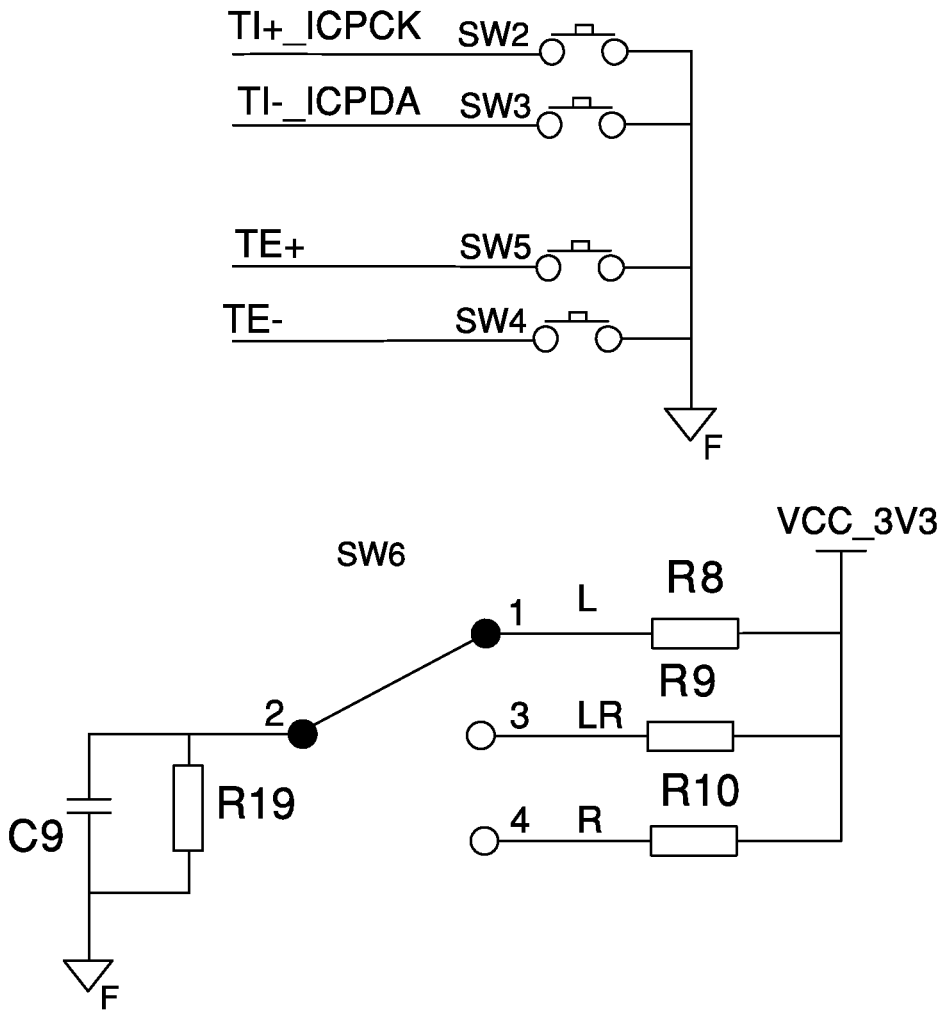
FIG. 10 is a circuit diagram of a first function button circuit according to an embodiment of the present invention.
Figure 11:
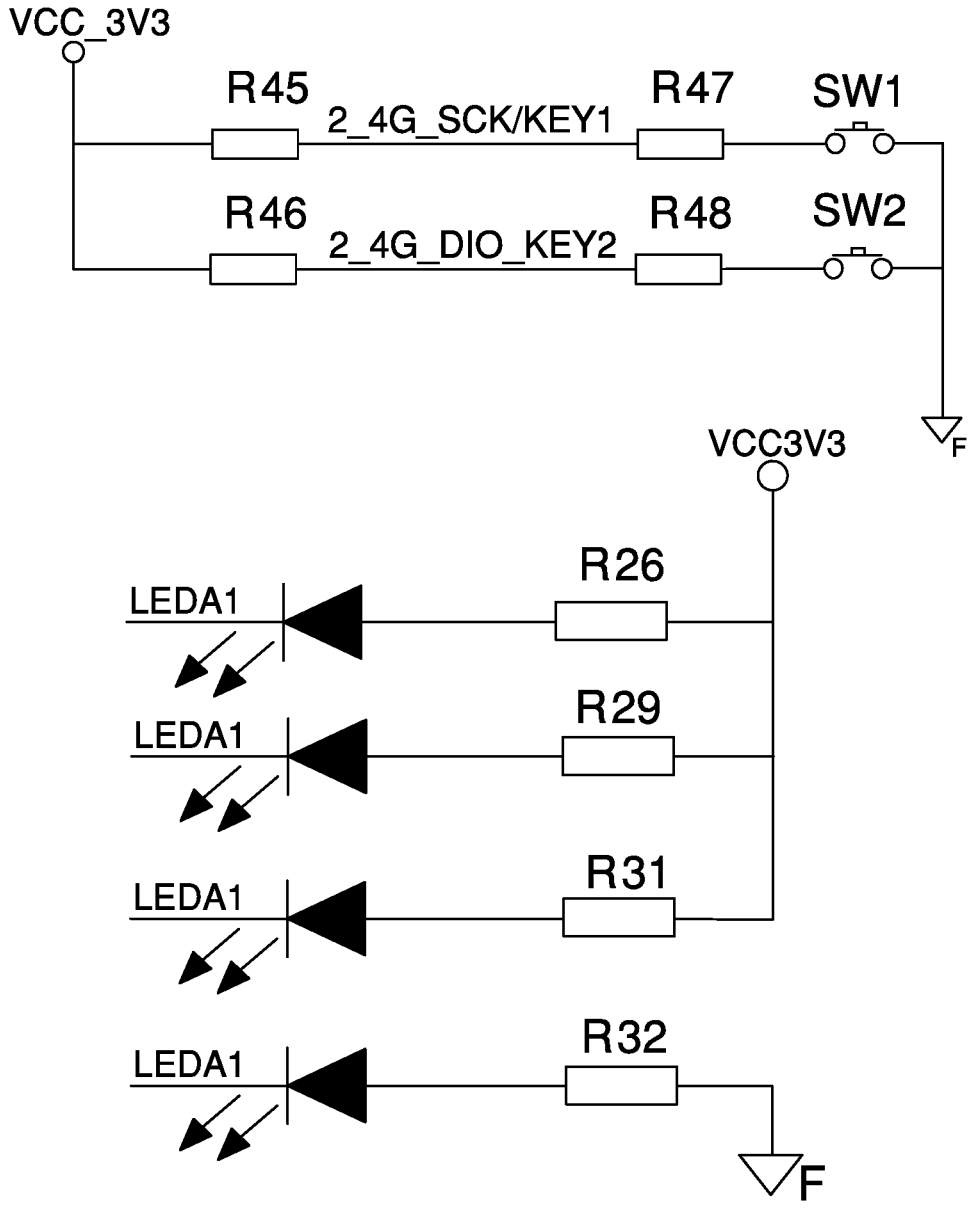
FIG. 11 is a circuit diagram of a second function button circuit and an indicator circuit according to an embodiment of the present invention.

The electric blanket body 10 is in communication with the remote controller 20 through the first wireless module 12 and the second wireless module 24. In this embodiment, as shown in FIG. 3 and FIG. 7, the circuit of each of the first wireless module 12 and the second wireless module 24 is composed of a 2.4 GHz radio frequency transceiver module with a model number BC5602 and a peripheral circuit.

The user can press the corresponding button of the remote controller 20 to transmit the corresponding temperature adjustment signal to the second main control circuit 21 through the first function button circuit 22. The second main control circuit 21 outputs two signals, one is in communication with the first wireless module 12 through the second wireless module 24, and the other displays the currently adjusted temperature value through the display circuit 23. After the remote controller 20 sends a control signal toward the electric blanket body 10, the first main control circuit 11 of the electric blanket body 10 controls the heating wire to work, and the first main control circuit 11 sends the status of the electric blanket body to the mobile terminal 30 so that the mobile terminal 30 displays the status of the electric blanket body synchronously.

In case the first main control circuit 11 and the mobile terminal 30 are wirelessly connected, after the user presses a corresponding button of the mobile terminal 30 (such as a mobile phone) and after the mobile terminal 30 sends a control signal toward the electric blanket body 10, the first main control circuit 11 of the electric blanket body 10 controls the heating wire to work, and the first main control circuit 11 sends the status of the electric blanket body to the remote controller 20 so that the remote controller 20 displays the status of the electric blanket body synchronously.

Therefore, the present invention can synchronize the remote controller 20 and the mobile terminal 30 (such as a mobile phone) to display the working state of the electric blanket. That is, if the electric blanket body 10 is operated by using the buttons of the remote controller 20, it will be sent to the mobile phone synchronously to achieve the consistency of the display and control. On the contrary, if the electric blanket body 10 is operated by using the buttons of the mobile phone, it will be sent to the remote controller 20 synchronously for display, which greatly improves the convenience of use.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An electric blanket, comprising:

an electric blanket body, the electric blanket body including a first wireless module, a heating wire, a detection circuit, a first power input circuit for supplying power, and a first main control circuit for wirelessly connecting a mobile terminal, the first main control circuit being connected to the heating wire;

a remote controller for remotely controlling the electric blanket body, the remote controller including a second main control circuit, a first function button circuit connected to the second main control circuit, a display circuit, a second wireless module, and a second power input circuit for supplying power, the electric blanket body being in communication with the remote controller through the first wireless module and the second wireless module;

wherein when the mobile terminal sends a control signal toward the electric blanket body, the first main control circuit of the electric blanket body controls the heating wire to work, and the first main control circuit sends a status of the electric blanket body to the remote controller so that the remote controller displays the status of the electric blanket body synchronously;

wherein when the remote controller sends a control signal toward the electric blanket body, the first main control circuit of the electric blanket body controls the heating wire to work, and the first main control circuit sends a status of the electric blanket body to the mobile terminal so that the mobile terminal displays the status of the electric blanket body synchronously;

wherein each of the first wireless module and the second wireless module is composed of a 2.4 GHz radio frequency transceiver module with a model number BC5602 and a peripheral circuit.

2. The electric blanket as claimed in claim 1, wherein the first main control circuit is composed of a Bluetooth main control chip U1 with a model number BCE32F7611 and a peripheral circuit.

3. The electric blanket as claimed in claim 1, wherein the heating wire includes at least two sub-heating wires, each sub-heating wire is equipped with an overheat protection circuit for overheat detection and blowout, the first main control circuit is connected to the overheat protection circuit, the electric blanket body further includes a fuse F1 disposed between a live wire of mains electricity and the first power input circuit, and the overheat protection circuit is connected to the fuse F1 for controlling the fuse F1 to blow.

4. The electric blanket as claimed in claim 3, wherein the overheat protection circuit includes a first diode, a second diode, a first unidirectional thyristor, a first resistor, a second resistor, a third resistor, a fourth resistor, and a temperature detection unit;

the first diode has a first anode and a first cathode for connecting the first power input circuit, the second diode has a second anode and a second cathode, the first anode and the second anode are connected to the temperature detection unit through the first resistor, the temperature detection unit is connected to the first main control circuit through the third resistor, and the first main control circuit is further connected to an analog ground through the fourth resistor;

the second cathode is connected to the analog ground, a T1 terminal of the first unidirectional thyristor is connected to the analog ground, a control terminal of the first unidirectional thyristor is connected to the first main control circuit through the second resistor, and a T2 terminal of the first unidirectional thyristor is connected to the temperature detection unit.

5. The electric blanket as claimed in claim 4, wherein the first resistor is a heating resistor, and the heating resistor is disposed on one side of the fuse F1 so that heat generated by the heating resistor can blow the fuse F1.

6. The electric blanket as claimed in claim 3, wherein each sub-heating wire is equipped with a constant temperature circuit, and the first main control circuit is connected to the corresponding sub-heating wire through the corresponding constant temperature circuit for controlling a working state of each sub-heating wire.

7. The electric blanket as claimed in claim 6, wherein the constant temperature circuit includes a second unidirectional thyristor, a fifth resistor, a sixth resistor, and a capacitor;

a control terminal of the second unidirectional thyristor is connected to the first main control circuit through the sixth resistor and the capacitor, a T1 terminal of the second unidirectional thyristor is grounded, the T1 terminal of the second unidirectional thyristor is further connected to the control terminal of the second unidirectional thyristor through the fifth resistor and the sixth resistor, and a T2 terminal of the second unidirectional thyristor is connected to the heating wire.

8. The electric blanket as claimed in claim 1, wherein the electric blanket body further includes a detection circuit, the detection circuit includes a resistor R2, a resistor R4, a resistor R10, a resistor R11, a resistor R12, a resistor R16, a fuse F2, and a fuse F3;

the resistor R11 has a first detection terminal and a second detection terminal for connecting the first power input circuit, the first detection terminal is connected to an analog ground through the resistor R12, the first main control circuit is connected to the first detection terminal, one end of the resistor R2 is connected to a digital ground, another end of the resistor R2 is connected to the analog ground through the fuse F2, the first main control circuit is connected to the digital ground through the resistor R10;

one end of the resistor R4 is connected to a signal ground, another end of the resistor R4 is connected to the analog ground through the fuse F3, and the first main control circuit is connected to the signal ground through the resistor R16.

9. The electric blanket as claimed in claim 1, wherein the electric blanket body further includes a second function button circuit and an indicator circuit for displaying a working state and a fault state, the second function button circuit and the indicator circuit are connected to the first main control circuit.

* * * * *